US006367716B1

(12) United States Patent
Wang

(10) Patent No.: US 6,367,716 B1
(45) Date of Patent: Apr. 9, 2002

(54) STRUCTURE FOR CONTROLLING WATER EMISSION OF PISTOL NOZZLE

(76) Inventor: Hsin-Fa Wang, No 68, Mou Tan Lane, Shao An Li, Lu Kang Township, Chang Hua Hsien (TW)

( * ) Notice: Subject to any disclaimer, the term of this patent is extended or adjusted under 35 U.S.C. 154(b) by 0 days.

(21) Appl. No.: 09/705,293

(22) Filed: Nov. 3, 2000

(51) Int. Cl.[7] ..... B05B 7/02; B05B 9/01; B05B 9/08

(52) U.S. Cl. ..... 239/526; 239/525; 239/530

(58) Field of Search ..... 239/457, 525, 239/526, 527, 530, 532, 581.1, 587.1, 587.4, 586

(56) References Cited

U.S. PATENT DOCUMENTS 4,997,131 A * 3/1991 Heren ..... 239/526
5,944,259 A * 8/1999 Brown ..... 239/526
5,984,207 A * 11/1999 Wang ..... 239/526
6,073,863 A * 6/2000 Wang ..... 239/526
6,129,294 A * 10/2000 Wang ..... 239/526

* cited by examiner

*Primary Examiner*—Henry C. Yuen
*Assistant Examiner*—Davis Hwu
(74) *Attorney, Agent, or Firm*—Harrison & Egbert

(57) ABSTRACT

A pistol nozzle is provided with a water emission controlling structure which is located at the water outlet of the main body of the pistol nozzle and is formed of an adjusting member and a shaft having a water emission hole. The shaft is actuated by the adjusting member to displace so as to align the water emission hole with a sleeve which is located between the main body and the nozzle head of the pistol nozzle. The amount of water emitted by the pistol nozzle depends on the extent to which the water emission hole of the shaft is aligned with the sleeve.

1 Claim, 4 Drawing Sheets

STRUCTURE FOR CONTROLLING WATER EMISSION OF PISTOL NOZZLE

BACKGROUND OF THE INVENTION

1. Field of the Invention

The present invention relates generally to a sprinkling system for watering a lawn, golf course, etc., and more particularly to a pistol nozzle.

2. Description of Related Art

The conventional pistol nozzles have a water emission controlling structure which is rather complicated in construction and is ineffective in controlling the water emission of the pistol nozzle. In addition, the water emission controlling structure of the conventional pistol nozzles is not cost-effective at best.

BRIEF SUMMARY OF THE INVENTION

It is the primary objective of the present invention to provide a pistol nozzle with a water emission controlling structure which is simple in construction.

It is another objective of the present invention to provide a pistol nozzle with a water emission controlling structure which can be made economically.

In keeping with the principle of the present invention, the foregoing objectives of the present invention are attained by the water emission controlling structure which is formed of a shaft, an adjusting member, two locating members, and two washers. The shaft is provided with a spherical segment having a water emission hole. The shaft is actuated to displace by the adjusting member, thereby resulting in the amount of water is allowed to pass through the water emission hole of the shaft.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
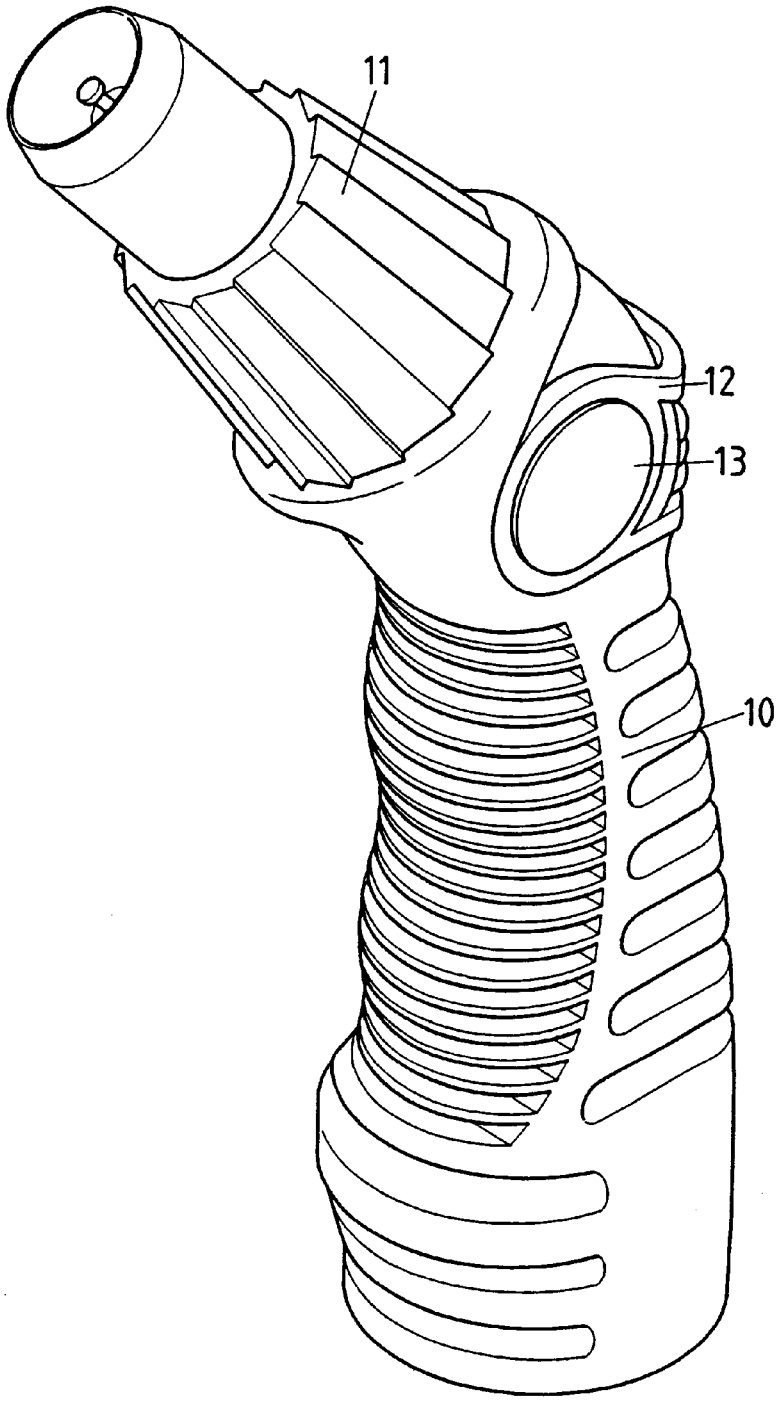
FIG. 1 shows a perspective view of the preferred embodiment of the present invention.
Figure 2:
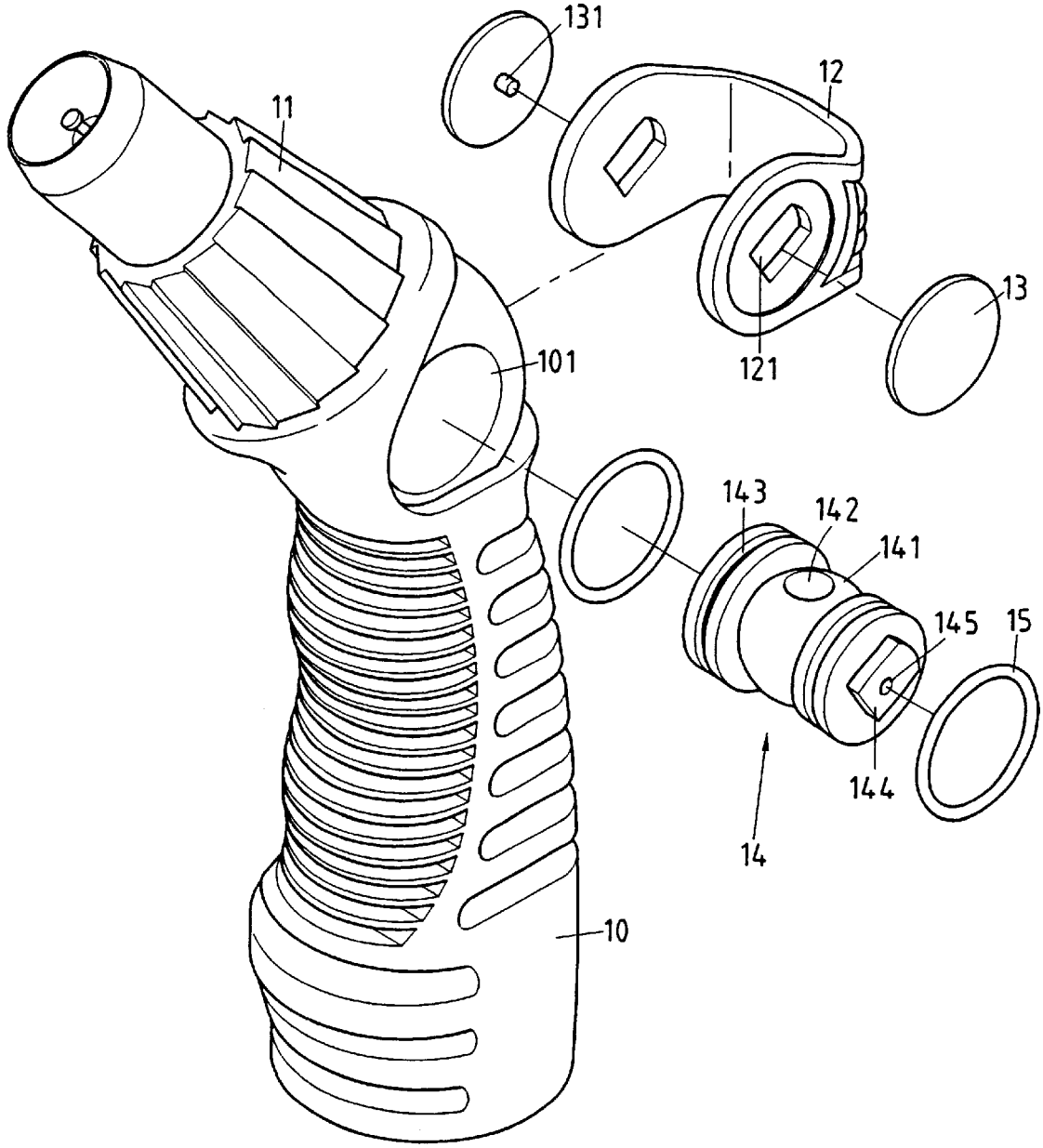
FIG. 2 shows an exploded view of the preferred embodiment of the present invention.
Figure 3:
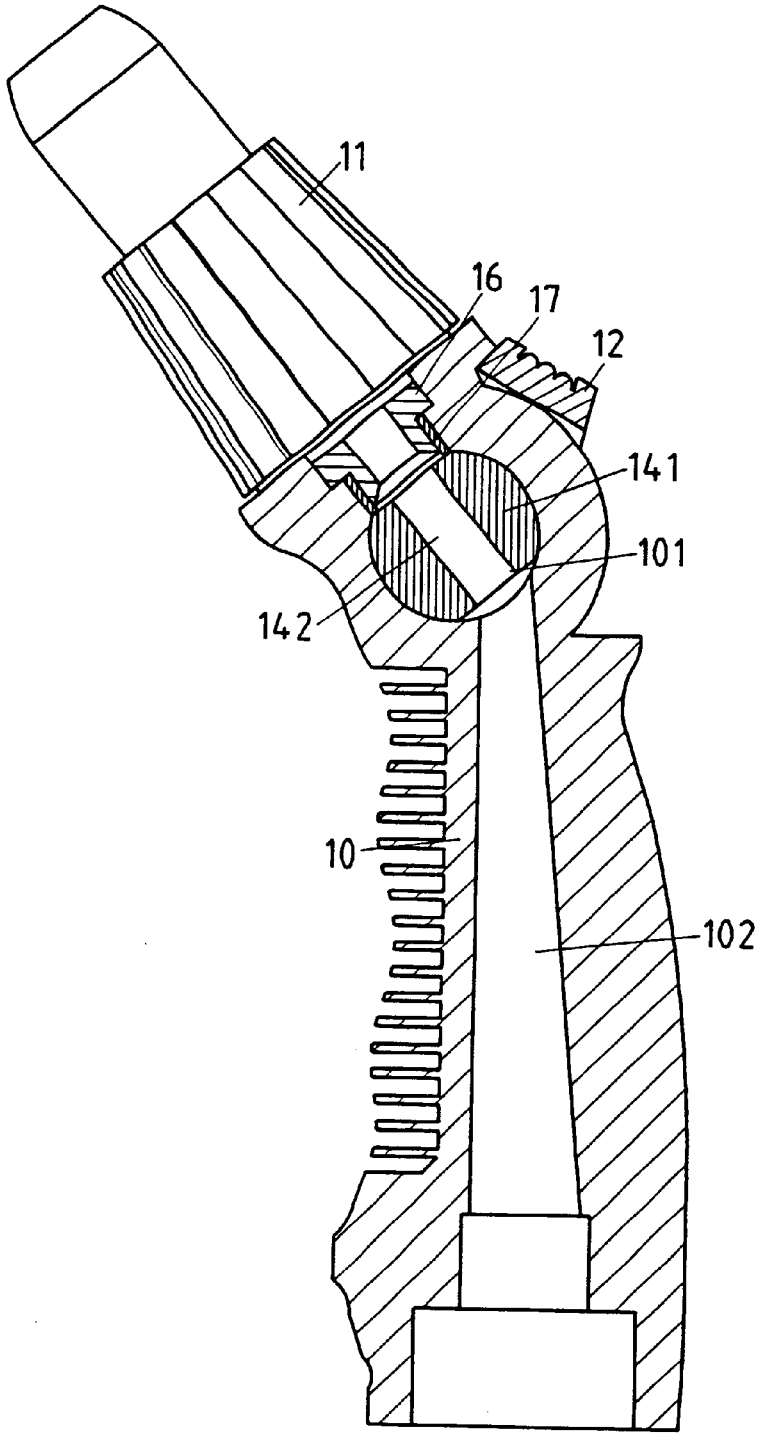
FIG. 3 shows a sectional schematic view of the preferred embodiment of the present invention in action.
Figure 4:
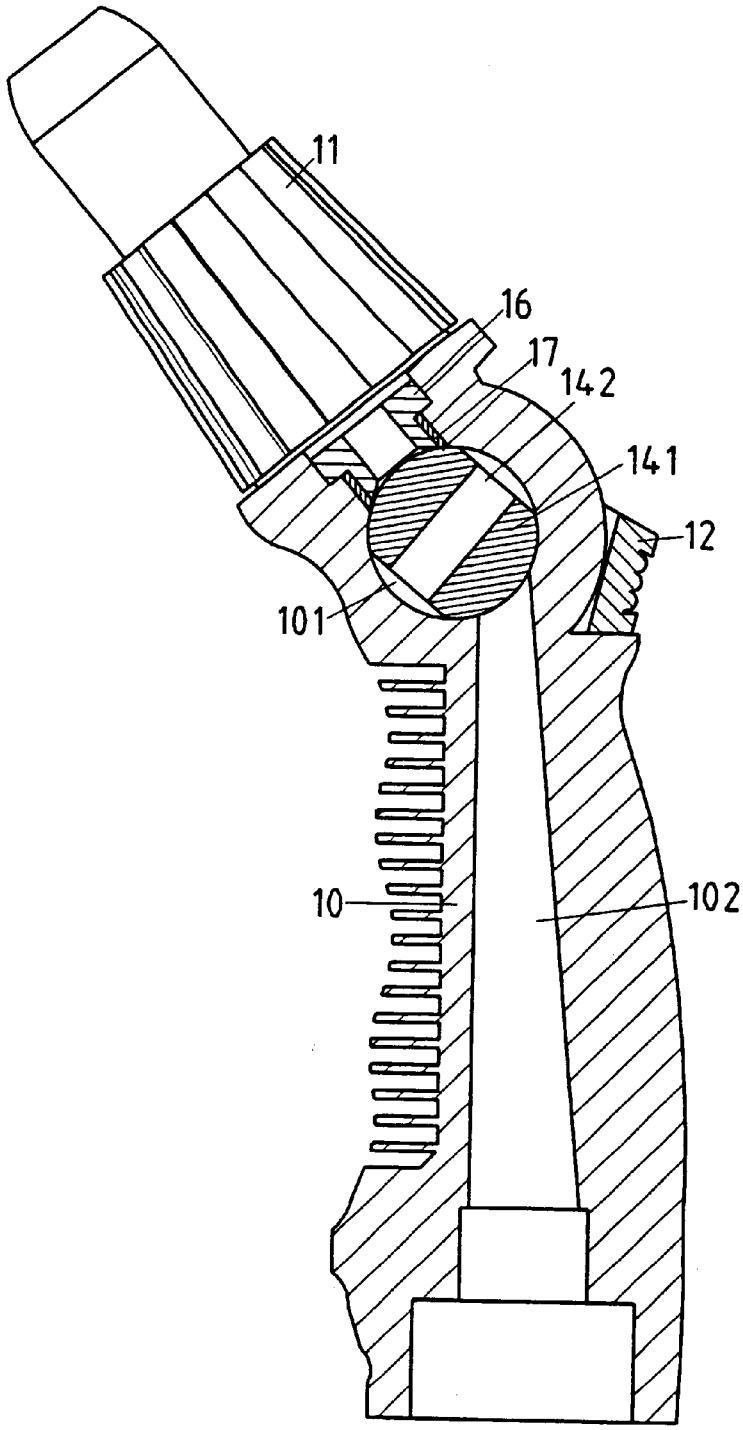
FIG. 4 shows another sectional schematic view of the preferred embodiment of the present invention in action.

As shown in FIGS. 1–4, a pistol nozzle of the preferred embodiment of the present invention has a main body 10 which is provided in the interior with a water conduit 102 extending along the longitudinal direction of the main body 10 such that the outer end of the water conduit 102 is in communication with a water outlet 101. The water emission controlling structure is disposed at the water outlet 101 in conjunction with a nozzle head 11.

The water emission controlling structure of the present invention comprises an adjusting member 12, two locating members 13, a shaft 14, and two washers 15.

The adjusting member 12 is of a U-shaped construction and is provided in two arms thereof with a fitting hole 121.

The adjusting member 12 is fitted over the water outlet 101 of the main body 10.

The locating members 13 are provided with a locating block 131.

The shaft 14 is provided in the midsegment with a spherical portion 141 having a water emission hole 142. The shaft 14 is provided in the outer wall of both longitudinal ends thereof with a retaining groove 143 and a protrusion 144 having a retaining hole 145.

The two washers 15 are respectively retained in the retaining groove 143 of the shaft 14.

In combination, the adjusting member 12 is joined with the shaft 14 such that the protrusions 144 of the shaft 14 are retained in the fitting holes 121 of the adjusting member 12, and that the adjusting member 12 and the shaft 14 are further located by the two locating members 13 whose locating blocks 131 are retained in the retaining holes 145 of the protrusions 144 of the shaft 14. The shaft 14 is disposed in the water emission outlet 101 of the main body 10 such that the spherical portion 141 of the shaft 14 is in an intimate contact with a washer 17 of a sleeve 16 which is located between the main body 10 and the nozzle head 11.

The shaft 14 is actuated by the adjusting member 12 to displace such that the water emission hole 142 of the shaft 14 is not aligned with the sleeve 16, thereby resulting in no water emission. If the water emission hole 142 is aligned with the sleeve 16, the amount of water emitted is the greatest. In other words, the amount of water that is emitted by the pistol nozzle of the present invention can be easily adjusted by the adjusting member 12.

I claim:

1. A water emission controlling structure comprising:

a pistol nozzle having a main body with a water conduit extending therethrough, said water conduit having a water outlet in communication therewith, said pistol nozzle having a nozzle head through which said water outlet extends, said pistol nozzle having a sleeve positioned between said main body and said nozzle head, said sleeve having a washer;

an adjusting member of a U-shaped construction and having two arms, each of said two arms having fitting hole formed therein;

two locating members each having a locating block;

a shaft having a generally spherical portion formed centrally therealong, said spherical portion having a water emission hole, said shaft having retaining grooves formed adjacent respective opposite ends thereof, said shaft having protrusions extending outwardly from respective opposite ends of said shaft, each of said protrusions having a retaining hole formed therein; and two washers respectively retained in said retaining grooves of said shaft, said shaft being disposed in said water outlet, said spherical portion of said shaft being in intimate contact with said washer of said sleeve, said protrusions of said shaft being retained respectively within the fitting holes of said adjusting member, said adjusting member and said shaft being retained by said two locating members such that the locating blocks are retained respectively in the retaining holes of said protrusions of said shaft, said shaft being rotatable by said adjusting member so as to align said water emission hole of said shaft with said sleeve.

* * * * *